US012000085B2

(12) United States Patent
Greene

(10) Patent No.: US 12,000,085 B2
(45) Date of Patent: Jun. 4, 2024

(54) METHOD FOR LIVE AREA PRINTING FOR DARK COLORED TEXTILES

(71) Applicant: Daniel Greene, Denver, CO (US)

(72) Inventor: Daniel Greene, Denver, CO (US)

( * ) Notice: Subject to any disclaimer, the term of this patent is extended or adjusted under 35 U.S.C. 154(b) by 1008 days.

(21) Appl. No.: 16/918,073

(22) Filed: Jul. 1, 2020

(65) Prior Publication Data

US 2022/0002941 A1 Jan. 6, 2022

(51) Int. Cl.

*D06P 5/30* (2006.01)
*D06B 11/00* (2006.01)
*D06P 5/20* (2006.01)

(52) U.S. Cl.

CPC ..... *D06P 5/30* (2013.01); *D06B 11/0059* (2013.01); *D06B 11/0076* (2013.01); *D06P 5/2077* (2013.01)

(58) Field of Classification Search

CPC .. B41M 5/0052; B41M 5/0094; B41M 5/035; B41M 2205/02; D06B 11/00; D06B 11/0056; D06B 11/0073; D06B 2700/04; D06B 2700/36; D06P 5/00; D06P 5/004; D06P 5/12

See application file for complete search history.

(56) References Cited

U.S. PATENT DOCUMENTS 3,716,326 A 2/1973 Dutta et al.
5,090,056 A 2/1992 Stoner et al.
5,144,899 A 9/1992 Allen
5,510,415 A 4/1996 Zahrobsky et al.
5,925,148 A 7/1999 Barfoed et al.
6,173,211 B1 1/2001 Williams et al.
6,312,123 B1 11/2001 Codos et al.
6,425,324 B1 7/2002 Yamamoto
6,458,211 B1 10/2002 Wefers et al.
6,736,485 B2 5/2004 Kushner et al.
6,854,146 B2 2/2005 Stoyles et al.
6,927,014 B1 8/2005 Figov
6,939,583 B2 9/2005 Katsuki et al.
7,134,749 B2 11/2006 Ben-Zur et al.
7,465,695 B2 12/2008 Tischer et al.

(Continued)

FOREIGN PATENT DOCUMENTS

EP 0416888 A2 3/1991
EP 1040936 A2 4/2000

(Continued)

OTHER PUBLICATIONS

International Search Report in International Application No. PCT/US20/51992 mailed Feb. 1, 2021, 4 pages.

(Continued)

*Primary Examiner* — William P Fletcher, III
(74) *Attorney, Agent, or Firm* — Berg Hill Greenleaf Ruscitti LLP

(57) ABSTRACT

A method for live area printing for textiles including manufacturing a textile blank with a white or uncolored live area that is assembled into a textile article. A design or image printed on the live area in a subsequent, single print run without the addition of a previously applied overlay required to set-off the ink such that customizable imagery or designs having a background color matched to the textile blank are reproduced upon the textile blank live area.

12 Claims, 9 Drawing Sheets

(56) References Cited

U.S. PATENT DOCUMENTS

| | | | | |
|---|---|---|---|---|
| 7,601,418 | B2 * | 10/2009 | Sheppard, Jr. | D06Q 1/00 428/196 |
| 8,088,441 | B2 | 1/2012 | Smith | |
| 8,328,339 | B2 | 12/2012 | Grasselli | |
| 8,731,703 | B1 | 5/2014 | Lehrer et al. | |
| 8,777,391 | B2 | 7/2014 | Okada et al. | |
| 8,881,652 | B2 | 11/2014 | Middo et al. | |
| 8,993,061 | B2 | 3/2015 | Jones et al. | |
| 9,120,326 | B2 | 9/2015 | Will et al. | |
| 9,333,788 | B2 | 5/2016 | Will et al. | |
| 9,545,808 | B2 | 1/2017 | Rosner et al. | |
| 9,550,374 | B1 | 1/2017 | Marino et al. | |
| 9,605,378 | B2 | 3/2017 | Asami et al. | |
| 9,624,390 | B2 | 4/2017 | Mann et al. | |
| 9,669,618 | B2 | 6/2017 | Bamberg et al. | |
| 9,738,095 | B2 | 8/2017 | Pervan et al. | |
| 10,834,982 | B2 * | 11/2020 | Northup | B41M 5/035 |
| 2001/0023157 | A1 * | 9/2001 | Sheppard, Jr. | D06Q 1/00 428/130 |
| 2001/0031591 | A1 * | 10/2001 | Sheppard, Jr. | D06Q 1/00 442/203 |
| 2004/0252173 | A1 * | 12/2004 | Ben-Zur | B41J 3/4078 347/101 |
| 2005/0018030 | A1 | 1/2005 | Brasier et al. | |
| 2008/0034508 | A1 | 2/2008 | Abbott et al. | |
| 2011/0169901 | A1 | 7/2011 | Pinto et al. | |
| 2013/0278692 | A1 | 10/2013 | Marino et al. | |
| 2016/0024709 | A1 | 1/2016 | Walker | |
| 2016/0031228 | A1 | 2/2016 | Will et al. | |
| 2016/0059622 | A1 | 3/2016 | Orcutt | |
| 2017/0145239 | A1 | 5/2017 | Mozel et al. | |
| 2018/0125139 | A1 | 5/2018 | Ruppert-Stroescu et al. | |
| 2018/0230647 | A1 | 8/2018 | Petton et al. | |

FOREIGN PATENT DOCUMENTS

| | | | | |
|---|---|---|---|---|
| EP | 1227936 | B1 | 7/2002 | |
| WO | WO-2018222710 | A1 * | 12/2018 | B41F 16/0046 |

OTHER PUBLICATIONS

Written Opinion in International Application No. PCT/US20/51992 mailed Feb. 1, 2021, 8 pages.

* cited by examiner

METHOD FOR LIVE AREA PRINTING FOR DARK COLORED TEXTILES

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

TO ALL WHOM IT MAY CONCERN

Be it known that I, Daniel Greene, a citizen of the United States, have invented new and useful improvements in a method for live area printing for dark colored textiles as described in this specification.

BACKGROUND OF THE INVENTION

Generally speaking, digital printing to textiles is preferable to silk screening because controlled application of known volumes of ink allows exact determinations of cost and creation of exact color profiles. Silk screening requires more time, more complex and involved setup of the press for each run, and repeated print runs so that independent layers may be added to build up a composite image by a layering of colors to ensure the full spectrum of colors is properly represented in the printed image. Significant downtime is thereby required as the press is set for each run, limiting output. Digital printing, on the other hand, allows for the application of individual pixels to build an image in a single print run to a specified and controlled color profile. This can control application of expensive inks but requires use of expensive print heads. Additionally, digital printing on darker colored textiles is complicated because the ink applied is absorbed into the textile fibers and thereby affected by the color of the textile fibers showing through. Therefore, creating exact colors, and matching exact coloration across a textile weave when printing at separate times, can be problematic.

To address this problem, contemplations in the prior art tend to rely on use of an additional substance, such as titanium dioxide for example, to first fix a white background to the textile and then immediately superimpose ink to set off the design element being printed. This ensures exact color representation but increases the expense of digitally printing directly to textiles. It also increases the time of the print run substantially since an overlay is first applied to the textile and then the printed image superimposed thereatop. The use of titanium dioxide and other substances to create the neutral color bed for the ink to adhere to also tends to substantially impact the lifespan of expensive print heads required in digital printing. Further, printing atop a fixed substance maintains the image only surficially upon the textile fibers whereby the permanence and vibrance of the image upon the textile is impacted and diminished with extended use.

Sublimation, on the other hand, enables the transfer of an image from a carrier, such as a transfer paper whereon the image is first printed as a mirror-image, by sublimating solid ink to a gas that penetrates and binds the ink into the textile fibers more thoroughly than silk screening or digital printing. As a result, sublimation is preferable for creating long-lasting printed designs on textiles. However, the above issues persist in creating a vibrant color match, especially when printing upon dark colored textile blanks at different times. Colors tend to be darkened by the overlapping application of sublimated ink superimposing upon already colored areas of the textile. This makes creating a constant color profile—represented by a corresponding constant color density across the textile—challenging for separate printing on a single textile, as when customizing textiles or producing textiles upon demand.

The present invention, therefore, seeks to address these and other issues by enabling bulk production of textile banks having a neutrally colored (bleach white) live area disposed thereupon in a particular location corresponding to a particular position upon the finished textile article fabricated from the blank, whereby individual and customizable images are printable to the live area once the garment or textile has been manufactured into its wearable or final form, without having to first print an overlay to set-off the color scheme or ensure perfect color matching between the live area and the surrounding, pre-printed or dyed textile.

The present invention, therefore, has been devised to create matched color profiles between a subsequently live area and the pre-printed textile blanks, wherein the background color of the live area is exactly matched to the textile blank and blended into the blank to render the live area indistinguishable from the remaining color profile of the garment or textile product.

Blanks can therefore be produced in bulk to reduce costs while enabling the addition of unique or customized designs to a finished garment upon demand. Known sized live areas enable customizing textiles by use of less expensive print equipment, such as the use of transfer paper to sublimate the image onto the live area, requiring only a printer devised for use with the transfer paper, and not a printer equipped to print directly to the textile itself.

FIELD OF THE INVENTION

The present invention relates to a method for live area printing for textiles that enables customizable printing to garments and articles created from specially produced textile blanks.

The blanks are produced having a live area incorporated thereupon as a specified zone for the addition of a printed image or design subsequently rendered upon a neutral colored, or white (bleach white), background. The blanks are producible in bulk as dark colored textiles, or textiles incorporating multicolored design elements throughout, with the exception of the live area(s).

Blanks are producible at quantity, with the live areas located appropriately for the incorporation of the customizable image(s) onto the finished article. The live area presents a neutral background upon which to set off single-run printing of the desired image or design upon demand, with the background properly matched to the color or design of the blank proper. The need of an additional overlay to neutralize the background color is obviated.

The present method therefore enables exact color matching between the live area and the colored blank without the need of a printed overlay to produce a neutral backing upon which the color must adhere. As a result, although the present method is usable with any printing method known in the art, including digital printing, sublimation is enabled whereby an image is molecularly bindable into the fibers of the textile to ensure vibrancy and longevity of the image or design with extended use. The present method therefore enables printing customizable images onto a variety of textile articles of different shapes and sizes. A single printer—devised for printing onto a range of sizes of sublimation transfer papers only, for example—is all that is needed to print across a range of textile articles for which different printers would otherwise be required, reducing the need for expensive equipment and enabling production of customized garments producible upon demand. Further, use of consistently sized live areas across textile articles enables an efficient method of ordering a customized article, consistent production parameters, and production of matched articles from a single uploaded image or order entered.

The present method therefore reduces the costs of customizable printing and creates a vibrant, long-lasting textile and/or article with extended vibrancy producible on demand.

SUMMARY OF THE INVENTION

The present invention contemplates production of textile blanks with a designated live area incorporated. The term "live area", as used herein throughout, describes an exact area upon a textile blank having specific dimensions matched to a digital print module or sublimation process, as will be described subsequently.

It should be noted that while silk screening onto the live area is possible, it is less desirable since the set-up time to run the required color profiles and layer-up the image increases time which the present invention is created to obviate. However, it should be noted that any method of printing to textiles is applicable for use with the current method.

The live area is contemplated to be a white, neutral, or uncolored portion of a dark textile blank, for example bleach white as rendered to textile blanks previous to the addition of color. The live area is positioned precisely upon the blank to correspond with a print area whereby a design can be printed therein after the textile article is manufactured. It should be noted that the entire live area is printed at a later time with a customizable image, enabling cost-effective production of customized textiles on demand. Where the added design is sized interior to the live area, the surrounding live area ("background") is printed with a color matched to the particular color of the textile blank to thereby render a seamless transition between the textile color and the design element. Feathered borders surrounding the live area that fade the textile color into the live area ensure exact color density between the live area and the surrounding blank is maintained, whereby a seamless transition between the live area and the surrounding color is perfected. The result is a textile article that appears as if it was produced with the customized design or image originally incorporated.

It should further be noted that, at initial production of the blanks, live areas may be produced upon any area of the textile blank suited for rendering a design at a particular position upon a person wearing the textile or displaying the finished article. Thus, blanks cut for the creation of T-shirts, for example, may have repeating live areas disposed at specific locations along the blanks corresponding with a design location desired for a particular T-shirt. Generally, live areas are produced on textile blanks in positions corresponding to the chest or breast area of the final T-shirts produced from the blank and/or upon the back of the T-shirts produced from the blank. However, it should be recognized by persons of ordinary skill in the art that the same concept of situating live areas in repeating fashion along a textile blank can correspond with differing design placements, as desired, including designs rendered along sides of a T-shirt produced from the blank, for example, or, where desirable, multiple live areas may be produced along the textile blank to render clothing or articles having multiple design placements thereon. Thus, live areas appropriate for customized sleeves, breasts, backs, sides, seams, pockets, or live areas disposed anywhere capable of receiving a design element upon the finished article, are contemplated as part of the scope of this invention.

Further, as is readily comprehensible to persons of ordinary skill in the relevant art, such live areas are producible upon blanks of textiles used for all garment types (including, for example, hats and headwear, shirts, T-shirts, pants, underwear, trousers, gloves, etc.) as well as for textiles that are not intended as garments per se, but as other textile articles including, for example, towels, pillows, rugs, throws, tapestries, fabric for furniture upholstery, etc. The general purpose of the present invention, then, is to allow the scaled production of blanks to create finished textile articles and garments which many by later customized with unique design elements upon demand. This lowers cost of production considerably, by enabling scaled, bulk production of the blanks and mass-production of the articles, while minimizing the expense of adding a customized design element individually printed at a later time.

Textile blanks are therefore produced for particular articles, including garments, upholstery, and other textile articles. Live areas are produced at time of manufacturing the blanks with exact placements upon the associated blank to correspond to particular positions upon the finished article rendered from the blank. The blank is therefore measured at precise intervals corresponding with location coordinates to ensure proper placement whereby the finished article is produced with the live area situated appropriately for incorporation of the later added-design element(s) or image(s).

It should be noted that the border of the live area is feathered at the time of manufacturing the blank, to fade the color of the textile into the live area a given distance. For example, in an example embodiment described herein, the blank may be rendered at 85% black (which is slightly less than the tolerance level afforded by sublimation and required to ensure a match of the sublimated image subsequently applied to the live area) and feathered from 85% black ("K") to 0% K over a distance of not more than two inches. When rendering the added design applied to sublimation transfer paper, for example, an inverse, complementary feather is incorporated, to overlay the feathered border proportionately to ensure a continuous color density is applied to fade the image into the surrounding textile whereby a seamless transition is effectuated between the design applied to the live area and the surrounding colored textile article. Thus, an accurate 85% K surrounds the finalized image or design applied to the live area that seamlessly blends transition from the live area into the color of the textile. An exact color match and color density is therefore maintained.

The present method for live area printing for textiles further enables customizable printing upon demand. Because the live area is of predetermined dimensions, corresponding transfer paper sizes are usable to sublimate a customized image, submitted, for example, online. An end user may, therefore, upload an image file through an online portal for production upon a customized textile article. Once the image is uploaded, a single print run may produce the mirror-image upon the appropriate transfer paper for sublimation to the article. Thus, customizable printing is possible on demand at low cost. For example, consider a school sports team that uses the same colored shirts, or patterned design, but the name and number upon each shirt must vary for each player. Having textile blanks produced at scale for the team colors enables custom printing of the name and number into the corresponding live areas with background matched to the overall textile design without having to produce individual shirts at manufacture or print directly to the textile proper. Customizable team jerseys are therefore producible on demand at relatively low cost.

The present method of the invention allows for the generation of customizable imagery or designs having a background color matched to the textile blank that can be reproduced upon the textile blank live area without the use of additional substances to bind, set, disburse and/or contrast the ink to the textile article. Thus, has been broadly outlined the more important features of the present method for live area printing for textiles so that the detailed description thereof that follows may be better understood and in order that the present contribution to the art may be better appreciated.

Objects of the present method for live area printing for textiles, along with various novel features that characterize the invention are particularly pointed out in the claims forming a part of this disclosure. For better understanding of the method for live area printing for textiles, its operating advantages and specific objects attained by its uses, refer to the accompanying drawings and description.

BRIEF DESCRIPTION OF THE DRAWINGS

Figures

FIG. 5 shows the complementary fade disposed upon the transfer paper from a maximum color density interior to the transfer paper to a minimum color density at the edge of the transfer paper which fade is devised to overlie the fade upon the garment to maintain a consistent color density transition from the live area to the garment proper to match the color of the garment.

DETAILED DESCRIPTION OF THE DRAWINGS

With reference now to the drawings, and in particular FIGS. 1 through 9 thereof, example of the instant method for live area printing for textiles employing the principles and concepts of the present method for live area printing for textiles and generally designated by the reference number 10 will be described.

Referring to FIGS. 1 through 9 a preferred embodiment of the present method for live area printing for textiles 10 is illustrated.

Figure 1:
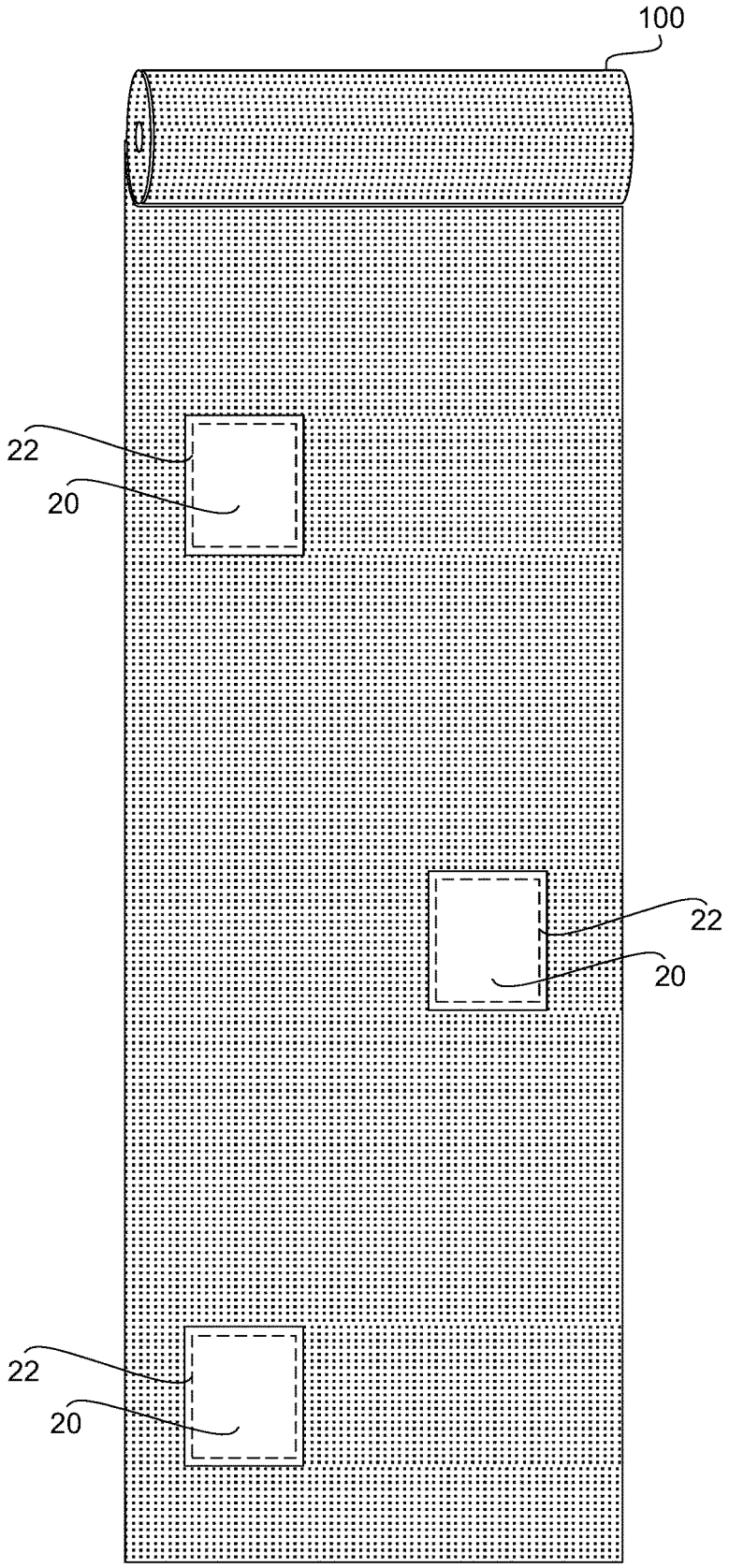
FIG. 1 is an elevation view of a textile blank having example live areas produced thereupon in exact position to correspond to the addition of a subsequently printed element into the live area.

Referring to FIG. 1, textile blanks 100 are produced with a live area 20 disposed at precise repeating intervals to correspond with a position upon each finished textile article 70. Printing of textile blanks 100 can be performed in any way known in the art, such as silk-screening for example, to mass produce the textile blank 100 of a desired color. Live areas 20 are created by preventing adherence of color to particular areas suited to the subsequent addition of a unique or customized design upon each finished textile article 70. Note that the textile blank 100 may be produced with any color profile, including multicolored designs representative of particular teams (for example) or with corresponding designs, as desired.

The live area 20 is produced with a feathered border 22 that includes a fade 24 (see FIG. 4) from a maximum color density, corresponding to the color density of the surrounding blank 100, to a zero-color density, interior to the live area 20. The feathered border 22 is applied as a continuous fade 24 across a constant distance, for example across a two-inch gradient into the lie area 20. However, additional distances are contemplated as part of this disclosure, matched to the particular article and color profile intended for each particular blank 100.

Figure 2:
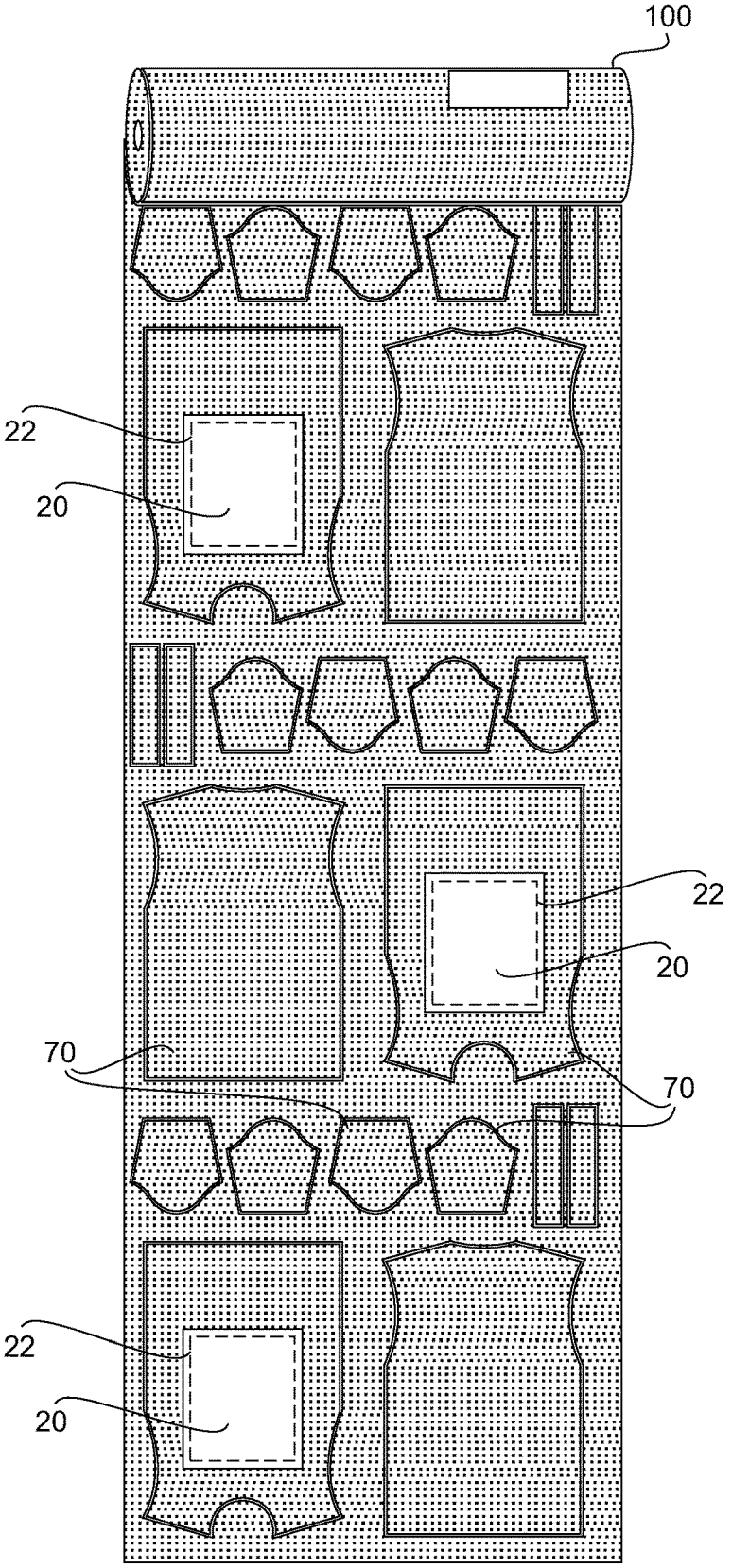
FIG. 2 is an elevation view of the textile blank showing the outlines for the garments as will be produced from the blank.
Figure 3:
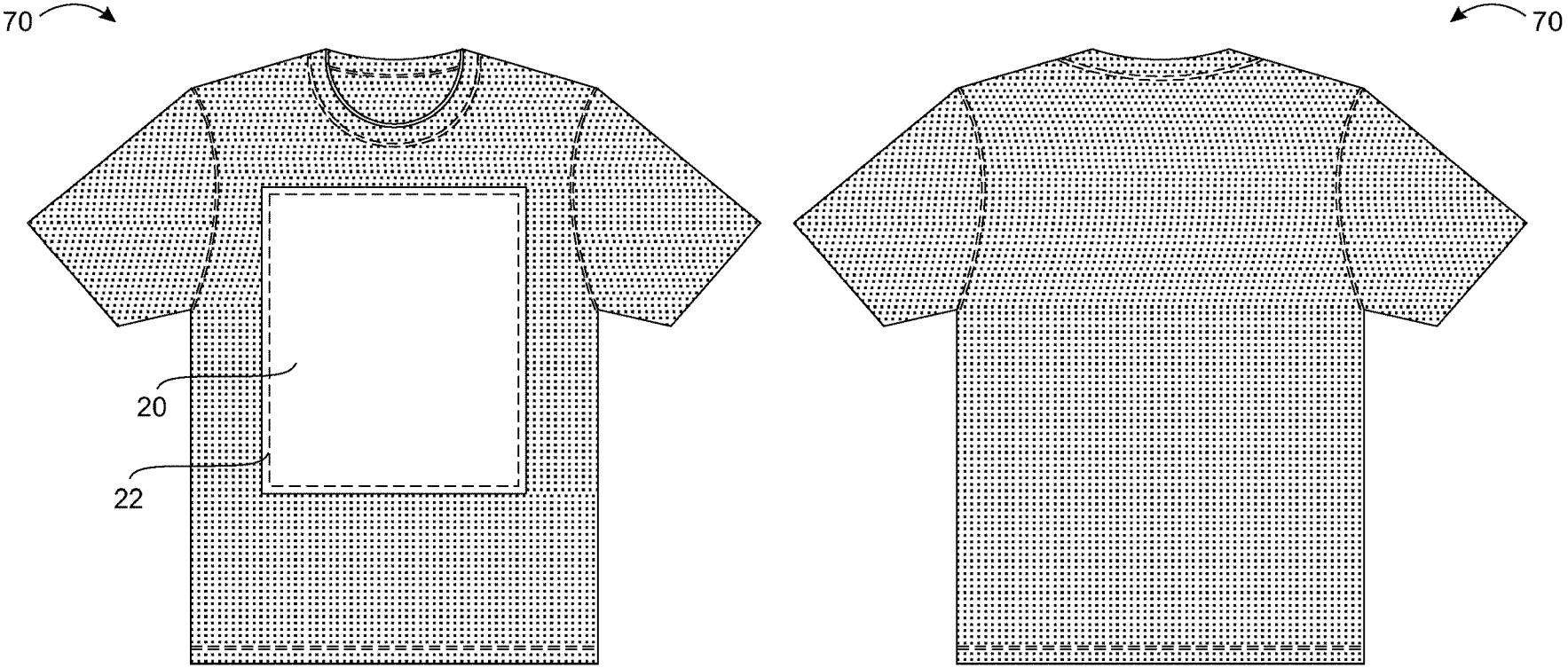
FIG. 3 is an elevation view of the front and rear of a T-shirt produced from the blank shown in FIG. 2 with an example live area disposed upon the breast.

Referring to FIGS. 2 and 3, textile blanks 100 are then cut and the finished article 70 is produced with the live area(s) 20 dispose at specific location(s) and determined size(s) that correspond to a digital print module or to specific sublimation transfer paper 30 sizes. Finished articles 70 are then shippable in bulk to retail or wholesale outlets whereat customizable printing to the corresponding live areas 20 is enabled on demand via a single print run with low-tech and/or smaller scale printing equipment for each order received. In the case of the example illustrated in FIG. 2, T-shirts are assembled with live areas 20 upon the breast. The backs of the T-shirts are blank. The finished article 70 assembled from the blank 100 is shown in FIG. 3. In such an example embodiment, an image may thence be printed to the breast of each finished T-shirt upon demand, with the image background exactly matched to the color profile of the blank 100, even where the blank color profile is a dark color or even multicolored, such as where the T-shirt is produced with a particular multicolored design or when showcasing colors devised to represent a particular sporting team, say.

Figure 4:
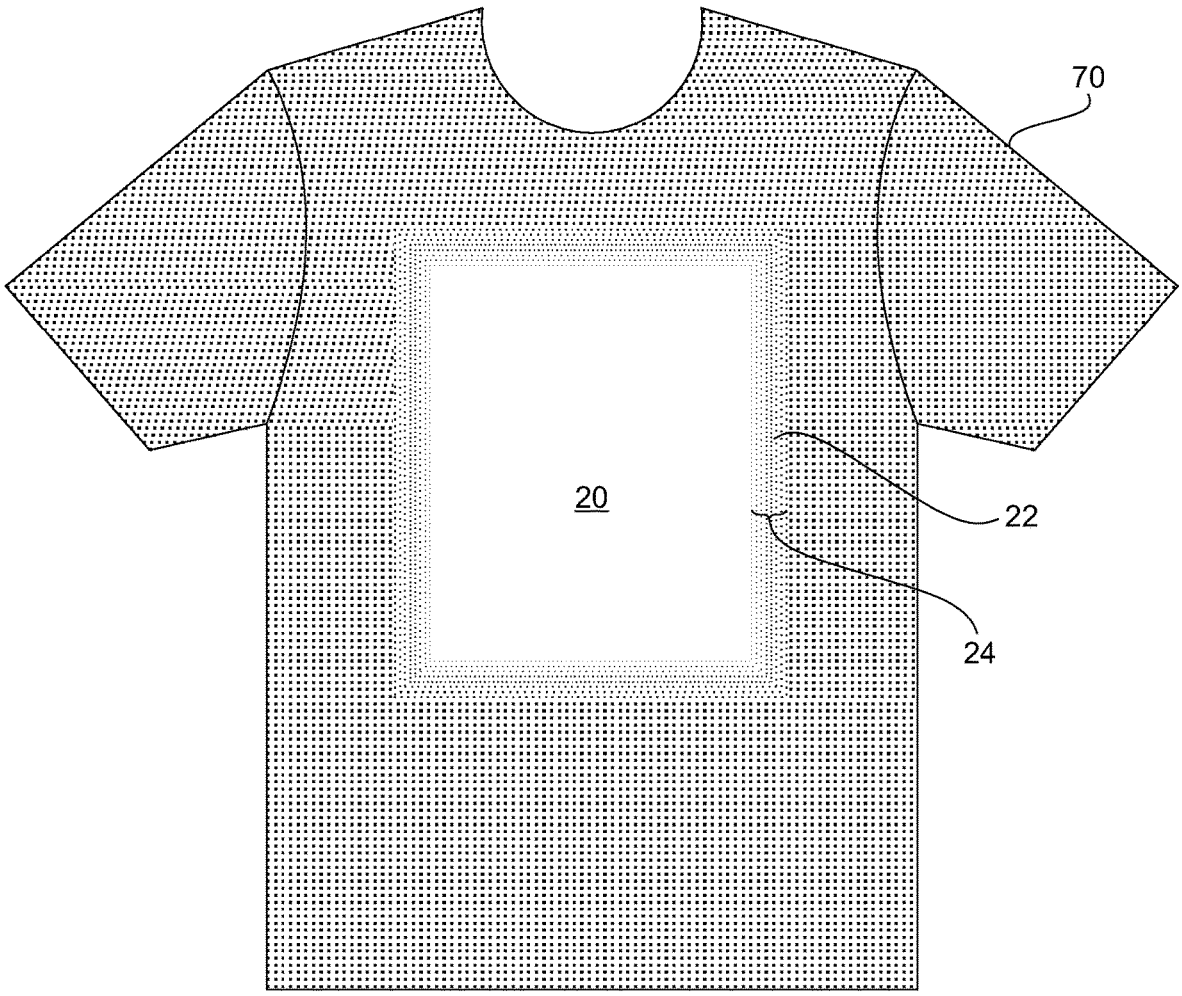
FIG. 4 is a detail view of the example live area disposed upon a T-shirt produced from the blank shown in FIG. 2 illustrating a fade from the colored garment into the live area, from a maximum color density to a minimum color density across a specific distance into the live area to ensure matched color and constant density across the printed live area when an image is subsequently printed thereto.
Figure 5:
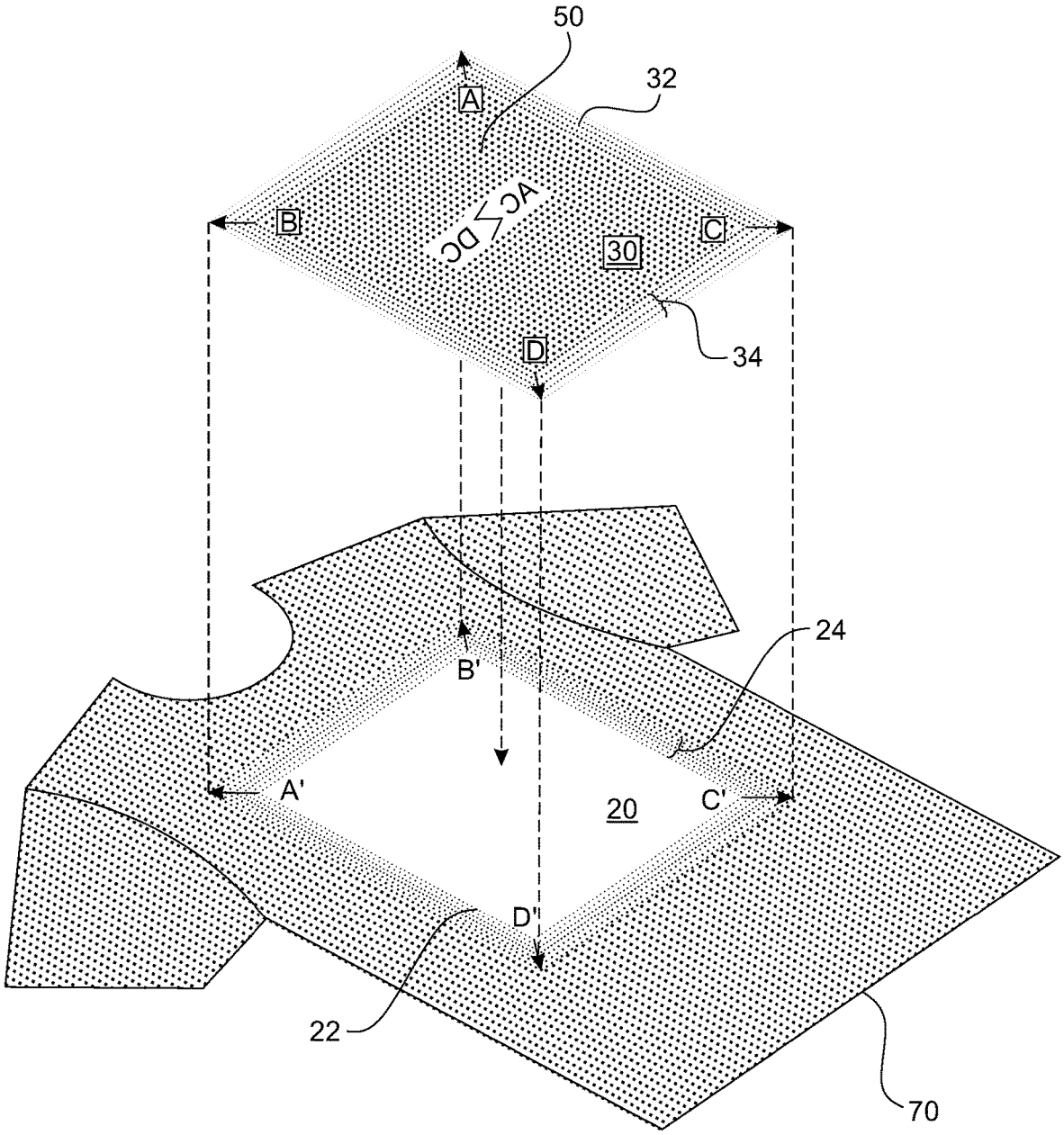
FIG. 5 is a diagrammatic view of a transfer paper for creating an individualized design upon the live area of the garment.

FIG. 4 is a detail view of an example embodiment of a feathered border 22 surrounding the live area 20. In this instance, the border 22 is feathered along a fade 24 from a maximum color density matched to the color density of the produced blank 100 down to a zero-color density within the live area 20 across a distance of at most two inches. As is shown in FIG. 5, an image or design element 50 printed to sublimation transfer paper 30 includes an inverse feathered border 32 devised to superimpose upon the feathered border 22 and produce a constant color density that perfectly blends the transition between the live area 20 and the surrounding textile article 70. In the example embodiment depicted, the maximum color density of the textile 70, produced upon the blank 100 is contemplated to be 85% black ("K"), which is approximately 2% less than the maximum achievable color density applicable to textiles using a sublimation process. In this example embodiment, this maximum color density is less than the maximum achievable color density to ensure a perfect match is rendered between the image applied to the live area 20 and the textile blank 100 during sublimation printing to the live area 20. Thus, the feathered border 22 produced upon the textile surrounding the live area(s) 20 continuously fades from an 85% K to a 0% K over a maximum of two in inches. Printing of a complementary feathered border 32 that superimposes an inversely disposed fade 34 (from 85% K to 0% K but in the opposite direction) therefore ensures a perfect color match consisting of, in this illustrative example, 85% K throughout to prevent an appearance of an outline surrounding the live area 20 after an image or design has been applied to the live area 20. Thus, the complementary fades 24 and 34 superimpose and create a continuous transition of color from the live area 20 to the garment proper to render a constant color profile with a perfect density match throughout.

FIG. 5 illustrates a sublimation transfer paper 30 with a mirror-image of a design element 50 printed thereupon for sublimation to the live area 20 upon the textile article 70. The inverse feathered border 32 bounding the mirror image 50 is printed to superimpose upon the feathered border 22 bounding the live area 20 to ensure a consistent color density is maintained across the transition between the textile 70 color profile and the color profile of the live area 20. Corner A of the transfer paper is aligned exactly to corner A' of the live area, corner B of the transfer paper is aligned exactly to corner B', corner C of the transfer paper is aligned exactly with corner C' of the live area, and corner D of the transfer paper is aligned exactly with corner D' of the live area. Superimposition of the transfer paper 30 upon the live area 20 ensures the complementary feathered borders 22, 23 superimpose to maintain the constant color density across the complementary fades 24, 34.

As discussed above, in this example embodiment herein illustrated, the maximum color density is contemplated to be 85% K, which is feathered to 0% K into the live area 20 upon the textile 70 along a continuous two inch fade 24, and the inverse feathered border 32 runs in the opposite direction along the same continuum to ensure a constant 85% K density throughout. It should be noted by persons of skill in the art that additional color densities are contemplated across a spectrum of color profiles and color combinations and multi-colored designs; the essential concept being the match of the complementary feathered border 32 of the transfer paper that superimposes upon the feathered border 22 of the live area 20 to ensure a consistent color density is applied whereby the transition between the design on the live area 20 and the surrounding textile color profile is seamlessly matched.

In this example embodiment, wherein the live area 20 is printed via sublimation, maximum color densities are controlled by the maximum achievable color density enabled by sublimation. Where digital printing is used to print to the live area 20 directly, the inverse feathered border 32 may be applied directly to the textile 70 during printing of the live area 20 whereby color densities are matched between the color density produced upon the textile blank 100 and the printed live area 20 at the time of actually printing the image or design directly to the live area 20. A seamless transition, therefore, between the color profile of the textile blank 100 and the live area 20 is ensured and visible outlines, borders, or discontinuities between the live area 20 and the textile 70 are avoided while a unique or customized design is applied to the live area 20 rendering a unique textile product or garment that is producible upon demand.

Figure 6:
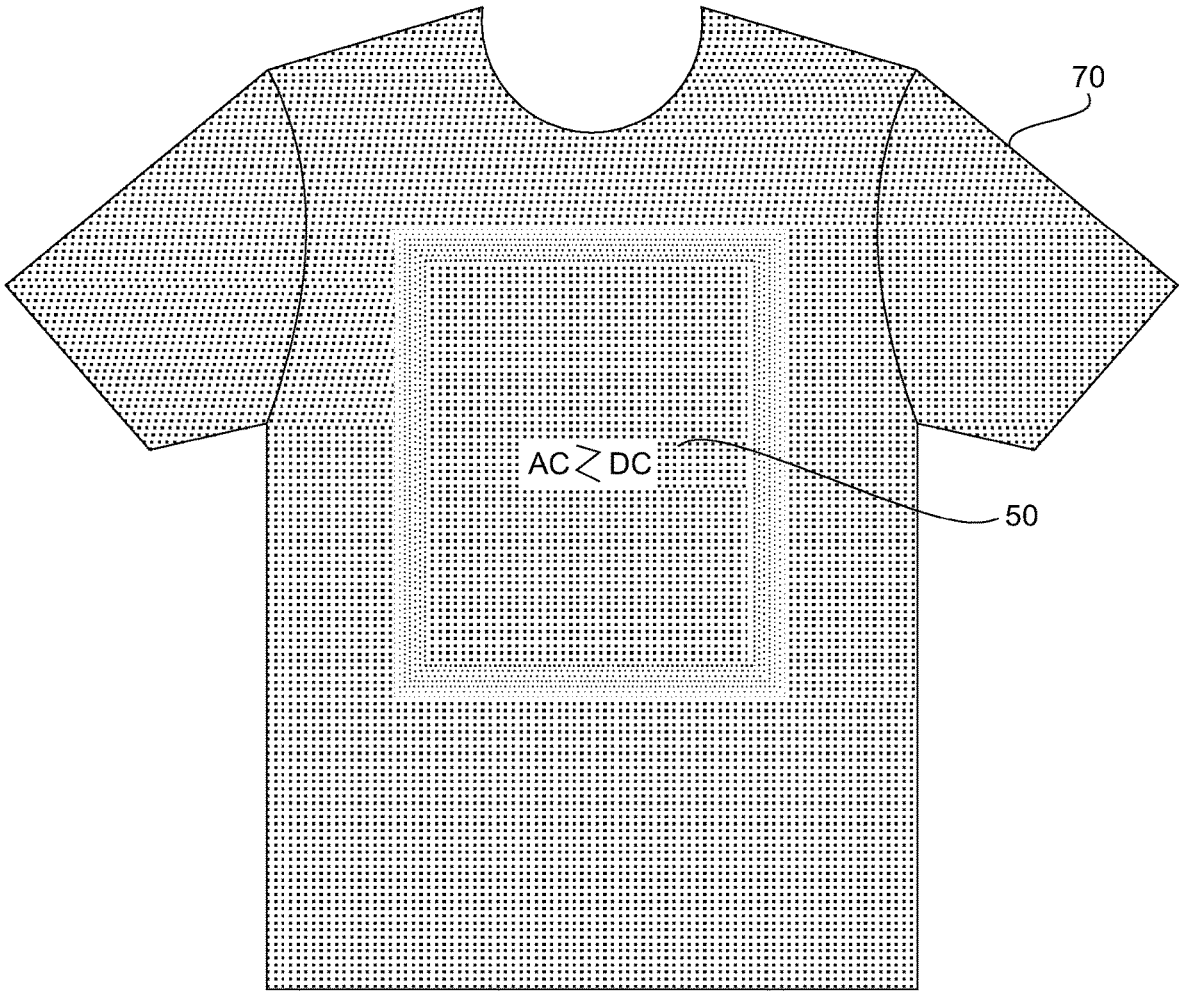
FIG. 6 is an elevation view of a T-shirt with the unique design applied to the live area.

FIG. 6 illustrates the textile article 70 (in this example. a T Shirt) with a customized image printed to the live area 20. A seamless transition between the live area 20 and the textile 70 is created by the superimposition of the complementary fades 22, 24 comprising the feathered borders 24, 34 during the printing upon demand.

Figure 7:
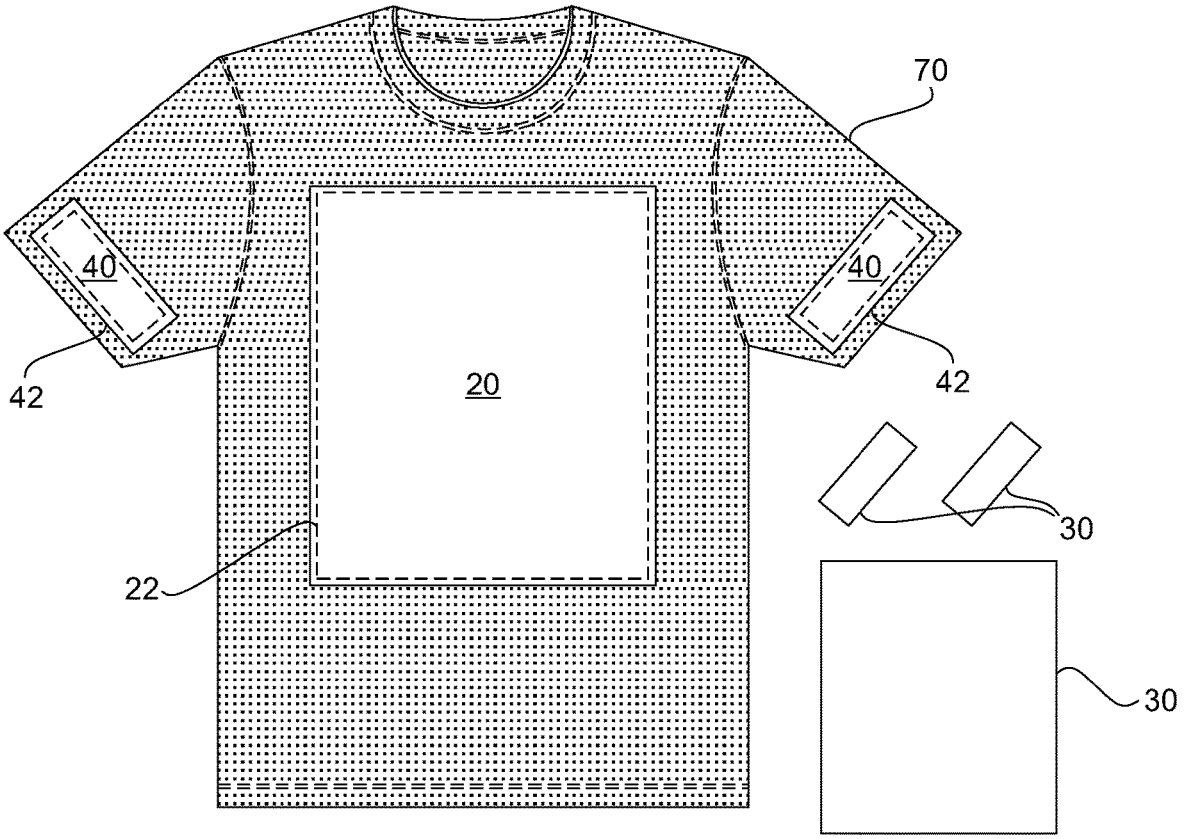
FIG. 7 is an elevation view of a garment produced having an example of a plurality of live areas at key places on the design suitable for the addition of a unique or customized design.

FIG. 7 illustrates an example embodiment of a textile 70 produced from a blank 100 for creating T-shirts and having additional live areas 40 of known dimensions disposed upon, in this example, the sleeves of the textile 70 for the receipt of additional customizable design elements, as may be desired when producing unique and customized textiles upon demand. In this example, using sublimation process, transfer papers 30 sized appropriate to these additional live areas 40 are used to print thereto in like manner as previously described. It should be understood that the scope of the method herein contemplated readily covers production of textile articles with live areas 20 disposed wherever customary or desirable for additional design elements to be added to the finished textile article, including, for example, to towels, beach towels, hats, cushions, pillows, throws, as well as other clothing articles, garments, and textiles.

Figure 8:
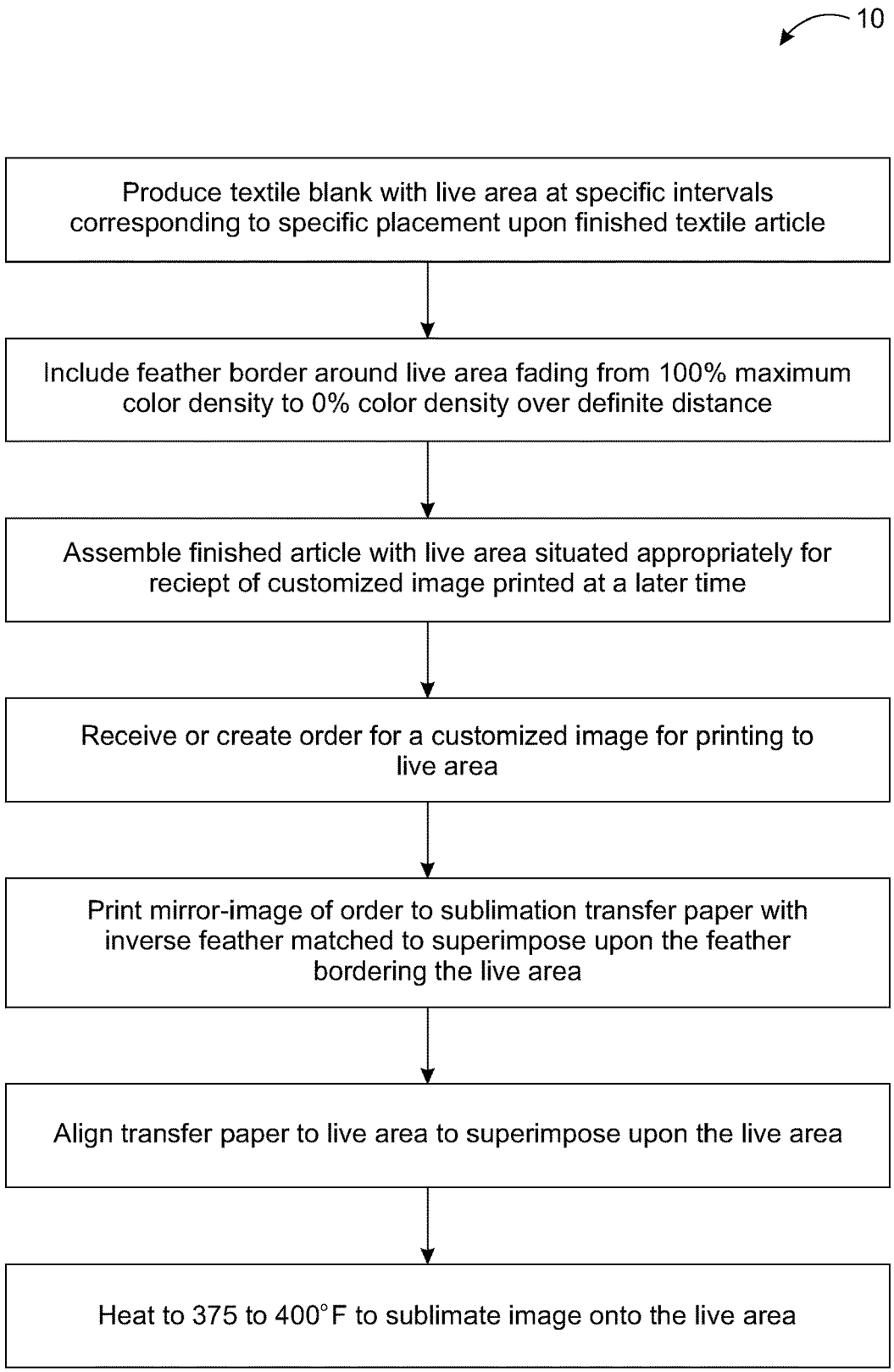
FIG. 8 is a flow diagram illustrating the steps of the method of mass producing garments having live areas to which customized or unique design elements may be added individually upon demand.

FIG. 8 illustrates a flow diagram outlining the steps of the present method 10 whereby textile blanks 100 are producible in bulk to render finished articles with live areas 20 appropriate for the addition of customized or unique designs upon demand and at appreciable cost savings.

Figure 9:
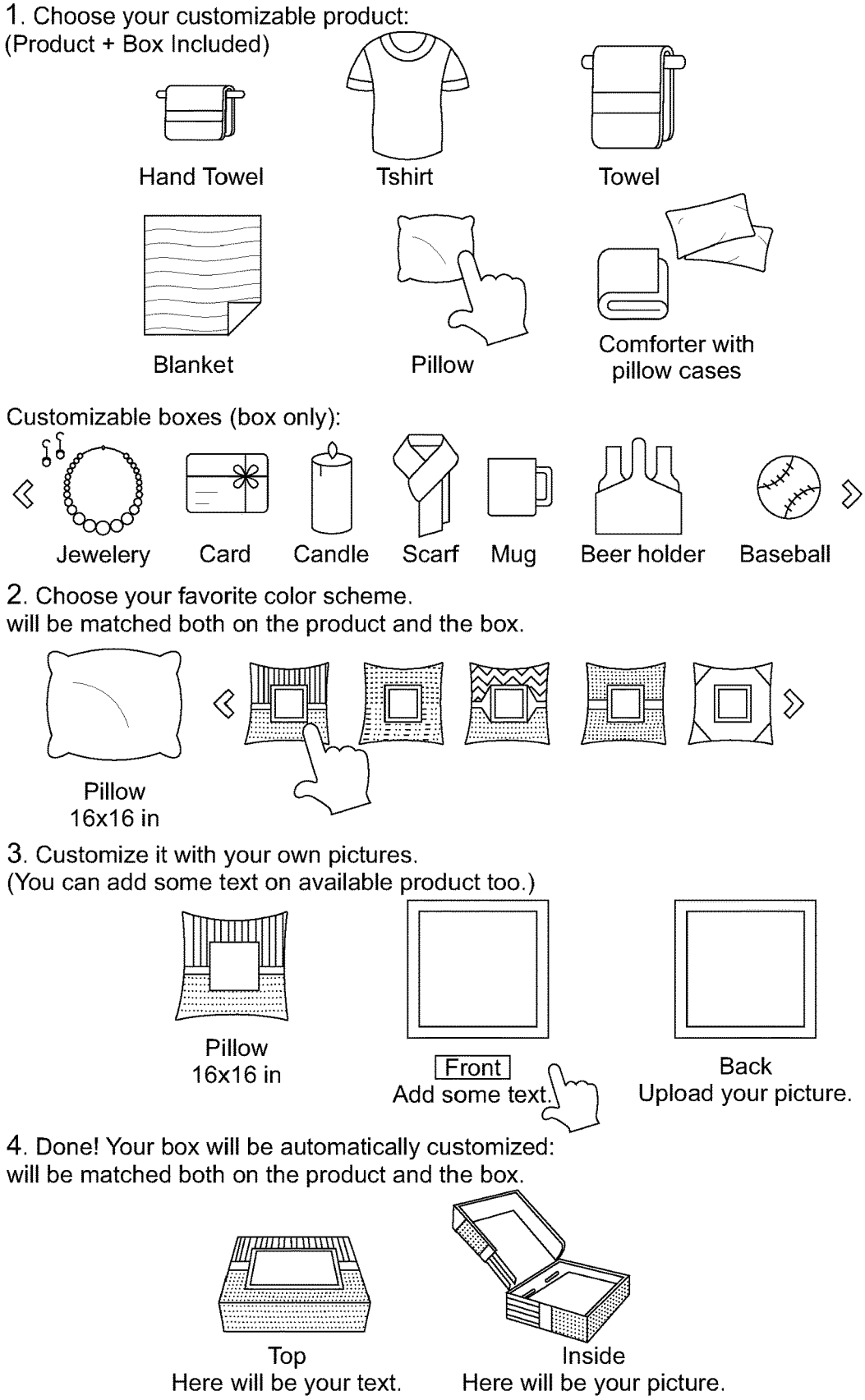
FIG. 9 is a diagram illustrating an example of a customer ordering a customized textile article online.

FIG. 9 illustrates an example method of ordering a customized textile article online in use of the present method. A customer is enabled to load an image to a live area 20 disposed upon a textile article 70, as desired. The article 70 is thence customized by printing to the live area 20 in the manner described herein. Because the live area 20 is a known size, images can be manipulated electronically to perfectly fit the live area 20 and also incorporated into other articles (including, as shown here, the packaging 72 with which the article 70 will be shipped). Transition between the background of the image applied and the surrounding textile article 70 are maintained at matched color densities by means of the method herein described. Thus a customized, unique, or individual textile article 70 is producible upon demand at minimal expense. The textile articles 70 are producible in bulk. The image printed to the live area 20 can be sublimated thereto by printing to the correspondingly sized transfer paper without the need of expensive printers capable of printing to larger items or directly to textile articles. Application of the requisite heat to the paper in position superimposed upon the live area 20 transfers the image to the live area 20, binding the color into the textile weave, penetration the fiber as a sublimated gas, for a longer-lasting color profile.

What is claimed is:

1. A method for live area printing for textiles comprising the steps of:

manufacturing a textile blank with white or uncolored live areas disposed at intervals set to present the live area in a specific location upon a finished textile article manufactured from the said textile blank;

assembling the textile article from the blank for distribution; and printing a design or image upon the live area in a subsequent, single print run without the addition of previously applied overly required to set-off the ink, wherein additional substances to bind, set, disburse, and/or contrast the ink to the textile article are unnecessary and customizable imagery or designs having a background color matched to the textile blank can be reproduced upon the textile blank live area on demand.

2. The method of claim 1 further comprising the steps of:

producing the live area upon the textile blank with a feathered border having a fade from a maximum color density, corresponding to the color density informing the textile blank, to a zero-color density applied over a prescribed distance; and printing the image to the live area with an inverse feathered border devised to superimpose upon the feathered border of the live area, wherein an inverse fade superimposes upon the feathered border of the textile article to ensure a constant color density is maintained across the transition between the live area and the textile article;

whereby the background color of the live area is matched to the color of the textile article and the density of the color is equalized to create a seamless transition between the textile article and the live area.

3. The method of claim 2 wherein printing to the live area is performed by a digital printer.

4. The method of claim 2 wherein printing to the live area is performed by sublimation printing wherein a mirror-image of the design is first printed to a sublimation transfer paper sized to superimpose upon the live area.

5. The method of claim 4 wherein the maximum color density applied to the textile blank is equal to or lesser than the maximum color density achievable by sublimation printing.

6. The method of claim 5 wherein the feathered border of the live area is matched with an inverse feathered border printed upon the sublimation transfer paper whereby the color density of a background of the live area is matched to the color density of the textile blank upon sublimation of the printed design or image.

7. The method of claim 1, wherein additional substances to bind, set, disburse or contrast the ink to the textile blank are not used.

8. A method for live area printing for textiles comprising the steps of:

producing a colored textile blank with at least one white or uncolored live area, said live area configured to specific dimensions matched to a live area digital print module operating upon a digital ink jet printer or sized to a corresponding transfer paper for sublimation printing;

producing the finished textile article from the blank such that the at least one live area is presented upon the textile article at a desired location for addition of a design or image printed onto the at least one live area at a subsequent time; and printing a design or image directly onto the at least one live area in a single print run with a background color matched to the color surrounding the live area on the textile article without the need of additional substances applied to the textile to set the ink in contrast during the said print run, wherein additional substances to bind, set, disburse, and/or contrast the ink to the textile blank are unnecessary whereby customizable imagery or designs having colors matched to the textile blank can be reproduced upon the textile blank live area upon demand.

9. The method of claim 8 further comprising the step of producing the live area upon the textile blank with a feathered border having a fade from a maximum color density, corresponding to the color density informing the textile blank, to a zero-color density applied over a prescribed distance.

10. The method of claim 9 further comprising the step of printing a design or image to the live area with an inverse feathered border devised to superimpose upon the feathered border of the live area, wherein an inverse fade superimposes upon the feathered border of the textile article to ensure a constant color density is maintained across the transition between the live area and the textile article whereby the background color of the live area is matched to the color of the textile article and the density of the color is equalized to create a seamless transition between the textile article and the live area.

11. The method of claim 10 wherein the step of printing a design or image to the live area further includes the septs of:

printing the design or image in mirror-image to a sublimation transfer paper sized to superimpose over the at least one live area;

positioning the sublimation transfer paper superimposed upon the live area wherein the inverse feathered border of the transfer paper superimposes upon the feathered border of the live area to maintain a constant color density across each of the complementary fades; and applying heat to sublimate the image or design from the transfer paper into a weave of the live area.

12. The method of claim 9, wherein additional substances to bind, set, disburse or contrast the ink to the textile blank are not used.

* * * * *